US007503332B2

(12) United States Patent
Gross et al.

(10) Patent No.: US 7,503,332 B2
(45) Date of Patent: Mar. 17, 2009

(54) SURFACTANT COMPOSITIONS, CLEANING COMPOSITIONS CONTAINING SAME, AND METHODS FOR USING

(75) Inventors: Stephen F. Gross, Souderton, PA (US); Anna Kvecher, Philadelphia, PA (US); Virginia Lazarowitz, Hatfield, PA (US); Timothy C. Morris, Morton, PA (US)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 11/781,376

(22) Filed: Jul. 23, 2007

(65) Prior Publication Data

US 2008/0039357 A1 Feb. 14, 2008

Related U.S. Application Data

(60) Provisional application No. 60/821,782, filed on Aug. 8, 2006.

(51) Int. Cl.

| | |
|---|---|
| ***B08B 3/04*** | (2006.01) |
| ***C11D 1/72*** | (2006.01) |
| ***C11D 1/722*** | (2006.01) |
| ***C11D 1/825*** | (2006.01) |
| ***C11D 3/22*** | (2006.01) |

(52) U.S. Cl. ..... 134/25.2; 134/25.3; 134/39; 134/42; 510/238; 510/239; 510/240; 510/421; 510/470; 510/474; 510/535

(58) Field of Classification Search ..... 510/238, 510/239, 240, 421, 470, 474, 535; 424/25.2, 424/39, 25.3, 42; 134/25.2, 25.3, 39, 42
See application file for complete search history.

(56) References Cited

U.S. PATENT DOCUMENTS

| | | | | |
|---|---|---|---|---|
| 5,573,707 | A | 11/1996 | Cole et al. | |
| 5,770,549 | A | 6/1998 | Gross | |
| 5,833,719 | A * | 11/1998 | Francois et al. | 8/111 |
| 6,530,383 | B1 * | 3/2003 | Rogmann et al. | 134/25.2 |
| 2003/0166494 | A1 * | 9/2003 | Man et al. | 510/466 |

* cited by examiner

*Primary Examiner*—Brian P Mruk

(57) ABSTRACT

A surfactant composition including an alkyl polyglycoside, an ethoxylated alcohol with an average of about 1 to about 30 moles of ethylene oxide per mole of alcohol, and an alkoxylated alcohol with an average of about 1 to about 30 moles of ethylene oxide and about 2 to about 60 moles of propylene oxide per mole of alcohol, with a ratio of moles of ethylene oxide to moles of propylene oxide of about 1:2 is provided. The surfactant composition including about 1% to about 50% by weight of an alkyl polyglycoside, about 1% to about 50% by weight of an ethoxylated alcohol, and, about 1% to about 50% by weight of an alkoxylated alcohol is also provided. A cleaning composition including the surfactant compositions described above is also provided. A method for cleaning hard surfaces includes applying to a hard surface the surfactant and cleaning compositions described above is also provided.

10 Claims, No Drawings

SURFACTANT COMPOSITIONS, CLEANING COMPOSITIONS CONTAINING SAME, AND METHODS FOR USING

CROSS-REFERENCE TO RELATED APPLICATIONS

This application claims priority under 35 U.S.C. § 119(e) from U.S. Provisional Application No. 60/821,782, filed on Aug. 8, 2006, the entire disclosure of which is hereby incorporated herein by reference.

FIELD OF THE INVENTION

The invention relates generally to surfactant compositions, and more particularly, to surfactant compositions including an alkyl polyglycoside, an ethoxylated alcohol, and an alkoxylated alcohol, cleaning compositions containing same, and methods for cleaning hard surfaces.

BACKGROUND INFORMATION

Ready-to-use All-Purpose Spray cleaners generally contain surfactants, solvents and alkaline builders. This three-component system is known as the "performance triangle". Generally, if one component is removed from the performance triangle, the hard surface cleaning ability of the composition is compromised.

The reduction or removal of solvent or volatile organic compound (VOC) content of consumer cleaning products is needed to comply with legislated VOC limits in certain states, and, alternatively, to help reduce the negative effects of VOCs in the atmosphere, for example, possible ozone depletion. The challenge for the formulator has been to maintain good hard surface detergency on oily soils without the use of any VOCs, for example, glycol ethers.

The reduction or removal of alkaline builder content of consumer cleaning products is needed to improve the overall safety of the formulation in terms of corrosivity, skin irritation, and compatibility with a wider variety of hard surfaces, and to make a cleaning composition essentially safe for all surfaces. The reduction or removal of alkaline builders also reduces formulation raw material costs.

There remains a need for a composition free of solvents and/or alkalinity which achieves a primary cleaning performance at least equal to or greater than commercially available formulas containing surfactants, solvents, and alkaline builders.

SUMMARY OF THE INVENTION

Briefly described, in one aspect of the invention, a surfactant composition includes an alkyl polyglycoside; an ethoxylated alcohol with an average of about 1 to about 30 moles of ethylene oxide per mole of alcohol; and an alkoxylated alcohol with an average of about 1 to about 30 moles of ethylene oxide and about 2 to about 60 moles of propylene oxide per mole of alcohol, wherein the ratio of moles of ethylene oxide to moles of propylene oxide is about 1:2.

In another aspect of the invention, a surfactant composition includes about 1% to about 50% by weight of an alkyl polyglycoside; about 1% to about 50% by weight of an ethoxylated alcohol; and, about 1% to about 50% by weight of an alkoxylated alcohol.

In another aspect of the invention, a cleaning composition includes the surfactant compositions described above.

In another aspect of the invention, a method for cleaning hard surfaces includes applying to a hard surface the surfactant compositions described above.

DETAILED DESCRIPTION OF THE INVENTION

Definitions

As used herein, the terms "comprises", "comprising", "includes", "including", "has", "having", or any other variation thereof, are intended to cover non-exclusive inclusions. For example, a process, method, article or apparatus that comprises a list of elements is not necessarily limited to only those elements but may include other elements not expressly listed or inherent to such process, method, article, or apparatus. In addition, unless expressly stated to the contrary, the term "of" refers to an inclusive "or" and not to an exclusive "or". For example, a condition A or B is satisfied by any one of the following: A is true (or present) and B is false (or not present); A is false (or not present) and B is true (or present); and both A and B are true (or present).

The terms "a" or "an" as used herein are to describe elements and components of the invention. This is done for convenience to the reader and to provide a general sense of the invention. The use of these terms in the description herein should be read and understood to include one or at least one. In addition, the singular also includes the plural unless indicated to the contrary. For example, reference to a composition containing "a compound" includes one or more compounds. As used in this specification and the appended claims, the term "or" is generally employed in its sense including "and/or" unless the content clearly dictates otherwise.

All numeric values are herein assumed to be modified by the term "about," whether or not explicitly indicated. The term "about" generally refers to a range of numbers that one of skill in the art would consider equivalent to the recited value (i.e., having the same function or result). In any instances, the terms "about" may include numbers that are rounded to the nearest significant figure.

Weight percent, percent by weight, and % by weight refer to the concentration of a substance and describe the weight of that substance divided by the weight of the composition and multiplied by 100.

The term "alkaline builder" refers to caustics, including, but not limited to sodium hydroxides, potassium hydroxides, silicates, including sodium and potassium silicates, amines, including monoethanolamines, sodium carbonates, and alkaline phosphates, including trisodium phosphates.

The term "alkyl" refers to a straight or branched chain monovalent hydrocarbon radical having a specified number of carbon atoms. Alkyl groups may be unsubstituted or substituted with substituents that do not interfere with the specified function of the composition. The carbon chain length may range from about 6 to about 18 carbon atoms.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition. The carbon chain length may range from about 6 to about 18 carbon atoms.

The term "controlled foam behavior" refers to the dynamic foam behavior of a surfactant or cleaning composition in the foam cell. The foam cell consists of a 2-liter jacketed graduate, peristaltic pump with variable voltage controller, and silicone and glass tubing. A test mixture is circulated at a constant temperature and flow rate, and falls from a constant height of 30 cm back into itself, creating foam. Controlled foam behavior means the foam breaks at the same rate that it forms, resulting in a constant foam volume over time.

The term "detergency" refers to the measure of the ability of a cleaning solution to remove soils from a substrate.

The term "hard surface" refers to surfaces including but not limited to metal, glass, ceramic, plastic and linoleum.

The term "nonionic" refers to a surface active compound (surfactant) with one or more uncharged hydrophilic substituents that does not generally dissociate as ions in a solution, distinguishable from anionic and cationic surfactants. The nonionic surfactants are primarily organic compounds having both hydrophilic and hydrophobic moieties.

The term "organic solvent" refers to a component, for example, glycol ethers or lower alcohols that are conventionally used in commercially available cleaning products.

The term "primary cleaning" refers to the performance property obtained upon removal of soil from a hard surface.

According to an aspect of the invention, a surfactant composition includes (a) an alkyl polyglycoside; (b) an ethoxylated alcohol with an average of about 1 to 30 moles of ethylene oxide per mole of alcohol; and (c) an alkoxylated alcohol with an average of about 1 to about 30 moles of ethylene oxide and about 2 to about 60 moles of propylene oxide per mole of alcohol, wherein the ratio of moles of ethylene oxide to moles of propylene oxide is about 1:2.

The alkyl polyglycoside may have an alkyl chain length of about 8 to about 16 carbon atoms, or about 8 to about 10 carbon atoms.

The ethoxylated alcohol may have an alkyl chain length of about 8 to about 16 carbon atoms, or about 8 to about 10 carbon atoms. The ethoxylated alcohol may have about 1 to about 10 moles of ethylene oxide, about 2 to about 6 moles of ethylene oxide, or about 4 moles of ethylene oxide. The ethoxylated alcohol may be an ethoxylated fatty alcohol.

The alkoxylated alcohol may have an alkyl chain length of about 12 to about 16 carbon atoms, or about 12 to about 14 carbon atoms. The alkoxylated alcohol may have about 1 to about 10 moles of ethylene oxide and about 2 to about 10 moles of propylene oxide, about 1 to about 8 moles of ethylene oxide and about 2 to about 10 moles of propylene oxide, about 2 to about 4 moles of ethylene oxide and about 4 to about 8 moles of propylene oxide, or about 3 moles of ethylene oxide and about 6 moles of propylene oxide. The alkoxylated alcohol may be an alkoxylated fatty alcohol. The alkoxylated fatty alcohol may be a block ethylene oxide/propylene oxide adduct.

The composition may have a pH of between about 1 and about 13, a pH of about 5 to about 9, or a pH of about 8.

According to another aspect of the invention, the surfactant composition may be incorporated into a ready-to-use spray cleaner, a concentrated cleaner, or a wet wipe. The surfactant composition may be present in these cleaners in an amount of from about 0.10% to about 99.0% by weight, or from about 0.20% to about 20.0% by weight. The composition may be diluted with water in any proportion. The surfactant composition may be diluted from 1:30 to 1:75 and applied to a non-woven substrate at a weight ratio of 1:3 (liquor:substrate). A suitable non-woven substrate may be 70% cellulosic, and 30% polyester.

In another aspect of the invention, a cleaning composition may include the surfactant composition described above. In the cleaning composition, the surfactant composition may have a pH of between about 1 to about 13, a pH of about 5 to about 9, or a pH of about 8. The surfactant composition may be present in an amount of 0.10% to about 99.0% by weight, or from about 0.20% to about 20.0% by weight. The cleaning composition may further include an alkaline source. The cleaning composition may further include a solvent. The cleaning composition including the surfactant composition is effective for cleaning hard surfaces.

In another aspect of the invention, a cleaning composition may consist essentially of the surfactant composition diluted with water. The cleaning composition may have a pH between about 5 and about 9, or a pH of about 8. The surfactant composition may be present in an amount of 0.10% to about 99.0% by weight. The cleaning composition is effective for cleaning hard surfaces.

According to another aspect of the invention, a surfactant composition includes (a) about 1% to about 50% by weight of an alkyl polyglycoside; (b) about 1% to about 50% by weight of an ethoxylated alcohol; and, (c) about 1% to about 50% by weight of an alkoxylated alcohol.

The alkyl polyglycoside may have an alkyl chain length of about 8 to about 16 carbon atoms, or about 8 to about 10 carbon atoms.

The ethoxylated alcohol may have an aikyl chain length of about 8 to about 16 carbon atoms, or about 8 to about 10 carbon atoms. The ethoxylated alcohol may have an average of about 1 to about 30 moles of ethylene oxide per mole of alcohol, or an average of about 1 to about 10 moles of ethylene oxide per mole of alcohol. The ethoxylated alcohol may be an ethoxylated fatty alcohol.

The alkoxylated alcohol may have an alkyl chain length of about 12 to about 16 carbon atoms, or about 12 to about 14 carbon atoms. The alkoxylated alcohol may have an average of about 1 to about 30 moles of ethylene oxide and about 2 to about 60 moles of propylene oxide per mole of alcohol, about 1 to 8 moles of ethylene oxide and about 2 to 10 moles of propylene oxide, or about 2 to about 4 moles of ethylene oxide and about 4 to about 8 moles of propylene oxide. The ratio of ethylene oxide to propylene oxide may be about 1:2. The alkoxylated alcohol may be an alkoxylated fatty alcohol. The alkoxylated fatty alcohol may be a block ethylene oxide/propylene oxide adduct.

The composition may have a pH between about 1 and about 13, or a pH of about 5 to about 9.

The surfactant composition may be in a concentrated form. The surfactant composition may be diluted with water. The surfactant composition may be present in an amount of 0.10% to about 99.0 % by weight, or from about 0.20% to about 20.0% by weight. The surfactant composition may further include an alkaline source. The surfactant composition may further include a solvent. The surfactant composition is effective for cleaning hard surfaces. The surfactant composition may include about 50% to about 65% by weight of a 60 to 65% active alkyl polyglycoside. The surfactant composition may include about 5% to about 15% by weight of an ethoxylated alcohol.

The surfactant composition may include about 25% to about 35% by weight of an alkoxylated alcohol.

In another aspect of the invention, a method for cleaning hard surfaces comprising applying to a hard surface the surfactant and cleaning compositions described above. The method may further include wiping the surfactant composition over the hard surface. The method may further include removing the surfactant composition from the hard surface. The method may further include diluting the surfactant composition prior to applying to the hard surface. The method may also include providing a wet wipe comprising the surfactant compositions described above, and applying the wet wipe to a hard surface.

Advantageously, according to an aspect of the invention, the surfactant composition exhibits a remarkable hard surface detergency. According to another aspect of the invention, the surfactant composition in combination with an alkaline builder increases the efficacy of the surfactant composition, but it is to be understood that the surfactant composition is remarkably effective without any conventional additives.

The absence of an alkaline builder and/or solvent in the surfactant composition makes it safer to use, as one need not protect skin surfaces during use or wash skin surfaces after contact with the surfactant composition to avoid damage by alkalinity.

The absence of a solvent also has added benefits. For example, there is no unpleasant odor, and no flashpoint which is associated with the use of solvents.

According to an aspect of the invention, the surfactant composition may be in a ready-to-use form, or present in a cleaning composition.

According to an aspect of the invention, the surfactant composition may be in concentrated form, or be diluted with water. When in concentrated form, an added advantage is that the cost of transport and storage is reduced. An additional advantage is that the consumer may dilute to the desired concentration.

Advantageously, according to an aspect of the invention, the surfactant composition achieves equivalent (or greater) hard surface detergency to commercial products which may have a pH of 12 or greater. Many of these commercial products contain surfactants, alkaline builders, and/or glycol ether solvents. As described above, the addition of alkaline builders to the present surfactant further improves primary cleaning, but the components are not necessary to achieve an equivalent (or greater) cleaning performance to commercially available ready-to-use hard surface cleaning products currently on the market.

An additional advantage is that the surfactant composition is non-ionic, and each component of the composition is non-ionic. The nonionic surfactant compositions are distinguishable from anionic or cationic surfactants in that the nonionic surfactant compositions generally do not dissociate as ions in a working solution. The non-ionic characteristics of the surfactant composition make it compatible with all other surfactant types.

Advantageously, the invention also exhibits controlled foam behavior in addition to high gloss retention on shiny, non-porous surfaces.

The surfactant composition used "as is" or in a cleaning composition formulated with the surfactant composition of the invention advantageously requires lower amounts of the surfactant actives compared to conventional cleaning compositions.

It is to be understood that although the surfactant composition is described with three components, the surfactant composition may include additional components, for example, dyes, fragrances, enzymes, disinfectants, and other useful or aesthetic components that do not materially affect the basic characteristics and efficacy of the composition.

Components

Alkyl Polyglycosides

An alkyl polyglycoside (APG®) is formed from the reaction of glucose and fatty alcohol. An APG® compound has a hydrophobic portion (carbon chain) and a hydrophilic portion (glycoside unit or group). When describing an APG®, the average degree of polymerization (DP) is mentioned. For example, in an APG® compound with a DP of about 1.4, there are, on average, 1.4 units of glucose for each alkyl group. An APG® compound is thus a mixture of varying amounts of glucose units on the molecule. It is to be understood that a DP of 1.4 does not mean that each molecule has 1.4 glucose units.

The term "alkyl polyglycoside" is used herein, but it is to be understood that they are also conventionally referred to as alkyl glycosides and may also be referred to as alkyl polysaccharides. It is also to be understood that reference to the APG® compound by weight refers to the APG® compound in solution, and that within the range of weights the percent active of commercially available APG® surfactant compounds is between about 50 to about 70 percent.

Alkyl polyglycosides may be represented by the following general formula:

$$R_1—O—(R_2O)_b\text{-}(Z)_a$$

wherein $R_1$ is a monovalent organic radical having from about 6 to about 30 carbon atoms, $R_2$ is a divalent alkylene radical having from 2 to 4 carbon atoms, and Z is a saccharide residue having 5 or 6 carbon atoms, b is a number from 0 to about 12, and a is a number of from 1 to 6.

A suitable APG® compound is available from Cognis Corporation under the trademark GLUCOPON® 215 UP (62% active), in which the alkyl group conins about 8 to about 10 carbon atoms and has an average degree of polymerization of 1.5. The term UP refers to unpreserved. Other suitable alkyl polyglucosides include APG® 325N (50% active), in which the alkyl group contains about 9 to about 11 carbon atoms with an average degree of polymerization of 1.5, and GLUCOPON® 425N (50% active), in which the alkyl group has 8 to 16 carbon atoms with an average degree of polymerization of 15.

Additional suitable alkyl polyglycosides include, but are not limited to GLUCOPON® 225DK, in which the alkyl group contains 8 to 10 carbon atoms and has an average DP of 1.7; GLUCOPON® 625UP, in which the alkyl group has 12 to 16 carbon atoms and has an average DP of 1.6; APG® 325N, in which the alkyl group has 9 to 11 carbon atoms and has an average DP of 1.5; GLUCOPON® 600UP, in which the alkyl group has 12 to 16 carbon atoms and has an average DP of 1.4; PLANTAREN 2000®, in which the alkyl group has 8 to 16 carbon atoms and has an average DP of 1.5; and PLANTAREN 1300®, in which the alkyl group has 12 to 16 carbon atoms and an average DP of 1.6.

Other suitable alkyl polyglycosides may also be useful in practicing the invention, and may include alkyl polyglucosides with a hydrophobic group containing from about 6 to about 30 carbon atoms, or alternatively, from about 10 to about 16 carbon atoms, and a polyglycoside hydrophilic group.

Other suitable examples include alkyl polyglycoside surfactant compositions which are comprised of mixtures of compounds of the above wherein Z represents a moiety derived from reducing a saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and a hydrophiliclipophilic balance (HLB) in the range of about 10 to about 16 and a non-Flory distribution of glycosides, which is comprised of a mixture of an alkyl monoglycoside and a mixture of alklyl polyglycosides having varying degrees of polymerization of 2 and higher in progressively decreasing amounts, in which the amount by weight of polyglycoside having a degree of polymerization of 2, or mixtures thereof, with the polyglycoside having a degree of polymerization of 3, predominate, in relation to the amount of monoglycoside, said composition having an average degree of polymerization of about 1.8 to about 3. These compositions, also known as peaked alkyl polyglycosides, can be prepared by separation of the monoglycoside from the original reaction mixture of alkyl monoglycoside and alkyl polyglycosides after removal of the alcohol. The separation may be carried out by molecular distillation and normally results in the removal of about 70 to about 95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire disclosure of which is hereby incorporated herein by reference.

Other suitable alkyl polyglycosides useful in the compositions according to the invention are those in which the alkyl moiety contains from 6 to 18 carbon atoms, and the average carbon chain length of the composition is from about 9 to about 14, and comprise a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both by components, comprise a Flory distribution of polyglycosides derived from an acid-catalyzed reaction of an alcohol containing about 6 to about 20 carbon atoms and a suitable saccharide from which excess alcohol has been separated.

A suitable alkyl polyglycoside for use according to an aspect of the invention may include a mixture of two or more alkyl polyglycosides. According to an aspect of the invention, there may be a broad distribution of carbon chain lengths, and in another aspect of the invention, there may a narrow distribution. For example, a broad distribution may include a carbon chain length of about 1 to about 30, about 6 to about 20, or about 8 to about 18, or there may be a narrower distribution having a chain length of about 8 to about 16, about 8 to about 12, or about 8 to about 10 carbon atoms.

Ethoxylated Alcohols

Ethoxylated alcohols are condensation products of aliphatic alcohols having from about 8 to about 18 carbon atoms, in either straight chain or branched chain configuration, with ethylene oxide (EO). Primary alcohol ethoxylates (linear) are represented by the following general formula:

$$R—O—(CH_2—CH_2—O)_n—H$$

wherein R is an alkyl radical having from about 8 to 18 carbon atoms, and n is a number of from 1 to 30. Secondary alcohol ethoxylates (branched) are represented by the following general formula:

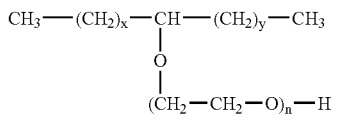

wherein x and y are numbers from 1 to 7, and n is a number of from 1 to 30. For example, a coconut alcohol ethylene oxide condensate has from about 10 to about 30 moles of ethylene oxide per mole of alcohol, and from about 10 to about 16 carbon atoms. Other suitable nonionic components may be selected from $C_8$-$C_{18}$ alcohol ethoxylates having from about 1 to 30 moles of ethylene oxide per mole of alcohol.

Suitable ethoxylated alcohol condensation products of a higher alcohol ($C_8$-$C_{18}$) in a straight or branched chain configuration, condensed with about 4 to 20 moles of ethylene oxide (EO), include, for example, but are not limited to, lauryl or myristyl alcohol condensed with about 16 moles of EO, tridecanol condensed with about 6 to 15 moles of EO, myristyl alcohol condensed with about 10 moles of EO per mole of alcohol, tallow alcohol ethoxylates containing 6 moles of EO to 11 moles of EO per mole of alcohol, and coconut fatty alcohol ethoxylates containing about 6 moles of EO to about 9 moles of EO per mole of alcohol.

In addition to the foregoing, suitable ethoxylates include, but are not limited to, NEODOL® ethoxylates (available from Shell Company, Texas), which are higher aliphatic, primary alcohols containing about 9-15 carbon atoms, for example, a $C_9$-$C_{11}$ alkanol condensed with 4 to 10 moles of EO (NEODOL® 91-8 or NEODOL® 91-5), a $C_{12}$-$C_{13}$ alkanol condensed with 6.5 moles EO (NEODOL® 23-6.5), a $C_{12}$-$C_{15}$ alkanol condensed with 12 moles EO (NEODOL® 25-12), and a $C_{14}$-$C_{15}$ alkanol condensed with 13 moles EO (NEODOL® 45-13), a $C_{12}$ alkanol condensed with 7 moles of ethylene oxide (NEODOL® 1-7), $C_9$-$C_{11}$ alkanol condensed with an average of 2.5 moles of ethylene oxide (NEODOL® 91-2.5); $C_9$-$C_{11}$ alkanol condensed with 6 moles of ethylene oxide (NEODOL® 91-6), $C_9$-$C_{11}$ alkanol condensed with 8 moles of ethylene oxide (NEODOL® 91-8), $C_{12}$-$C_{13}$ alkanol condensed with 6.5 moles ethylene oxide (NEODOL® 23-6.5), $C_{12}$-$C_{13}$ alkanol condensed with 7 moles ethylene oxide (NEODOL 23-7), $C_{12}$-$C_{15}$ alkanol condensed with 7 moles of ethylene oxide (NEODOL® 25-7), $C_{12}$-$C_{15}$ alkanol condensed with 9 moles ethylene oxide (NEODOL® 25-9), $C_{12}$-$C_{15}$ alkanol condensed with 12 moles ethylene oxide (NEODOL® 25-12), and $C_{14}$-$C_{15}$ alkanol condensed with 13 moles ethylene oxide (NEODOL® 45-13).

Other examples of ethoxylated alcohols suitable for use are available also from Cognis Corporation under the trademark TRYCOL® ST-8049, which is an ethoxylated C8-10 alcohol with about 4 moles of ethylene oxide, and also ALFONIC® 810-4.5, an ethoxylated $C_8$-$C_{10}$ alcohol with 4.5 moles of EO available from Sasol Corp.

Additional suitable ethoxylated alcohol condensates include the condensation products of secondary aliphatic alcohols containing 8 to 18 carbon atoms, in either a straight or branched chain configuration, condensed with 5 to 30 moles of ethylene oxide. Examples of commercially available nonionic detergents include $C_{11}$-$C_{15}$ secondary alkanol condensed with either 9 EO (TERGITOL® 15-S-9) or 12 EO (TERGITOL® 15-S-12) marketed by Union Carbide. Other suitable ethoxylated alcohols include those currently commercially available under the trade name "PLURONIC®".

Alkoxylated Alcohols

Alkoxylated alcohols include the condensation products of a higher alcohol, for example, an alkanol containing about 8 to 18 carbon atoms in a straight or branched chain configuration, condensed with about 1 to 30 moles of EO and with about 2 to 60 moles of propylene oxide (PO). An alkoxylated alcohol may also be condensed with, in addition to EO and PO, butylene oxide (BO).

Alkoxylated alcohols for use according to an aspect of the invention include compounds according to the general formula:

$$RO(EO)_x(PO)_yH$$

where R is a hydrocarbon chain of from 2 to 24 carbon atoms, EO is ethylene oxide and PO is propylene oxide, and x and y represent the average degree of ethoxylation and propoxylation, respectively, of from 1 to 30 and 2 to 60, respectively. The hydrophobic moiety of the nonionic compound may be a primary or secondary, straight or branched alcohol having from 8 to 24 carbon atoms.

Suitable alkoxylated alcohols are commercially available from Rhodia, Inc. under the trademark ANTAROX®, from Huntsman Corp. under the trademark SURFONIC® LF, or from Cognis Corporation under the trademark DEHYPON®.

The alkoxylated alcohols may also be present as an EO-PO adduct and may be prepared by polyaddition to an alcohol. They may be present as a block copolymer. Suitable EO-PO adducts preferably contain between 1 and 30 moles of EO and 2 to 60 moles of PO. The molar ratio between EO and PO is generally about 1:2. Suitable fatty alcohols for use in the preparing the alkoxylated alcohols include, but are not limited to fatty alcohols with 12-14 carbon atoms.

A suitable alkaline builder for use according to an aspect of the invention includes, but is not limited to caustics, including, but not limited to sodium hydroxides, potassium hydroxides, silicates, including sodium and potassium silicates, amines, including monoethanolamines, sodium carbonates, and alkaline phosphates, including trisodium phosphates.

The surfactant composition is prepared by mixing, in a suitable vessel, an alkyl polyglycoside, an ethoxylated alcohol, and an alkoxylated alcohol. The pH is adjusted to about 7 to about 9 and a preservative may be added to prevent microbial growth.

It is to be understood that although the surfactant composition is described with three components, the surfactant composition may include additional components that do not materially affect the effectiveness of the composition. For example, dyes, fragrances, pH modifiers, and preservatives may be added. In addition, when formulating the surfactant composition in an end product, an appropriate hydrotope may be added, for example, EMULGIN® HRE-40 or HRE-69 (hydrogenated castor oil+40EO or 60EO, respectively).

Unless otherwise defined, all technical and scientific terms used herein have the same meaning as commonly understood by one of ordinary skill in the art to which the invention belongs. Although methods and materials similar or equivalent to those described herein can be used in the practice or testing of the invention, suitable methods and materials are described below. In addition, the materials, methods and examples are illustrative only and are not intended to be limiting.

EXAMPLES

Example 1

In Example 1, a representative surfactant composition was prepared by blending the three components listed below, and thereafter adjusting pH with sulfuric acid.

| Sample 1 | % weight | % Active |
|---|---|---|
| GLUCOPON 215 CS UP | 58.03 | 36.27 |
| TRYCOL ST-8049 | 10.06 | 10.06 |
| DEHYPON LS-36 | 30.30 | 30.30 |
| $H_2SO4$ (30%, to pH 8) | 1.61 | 0.00 |
| | 100.0 | 76.63 |

The surfactant composition of Example 1 was compared to a solution of nonylphenol ethoxylate (NP-9), a non-ionic surfactant (9 refers to the number of moles of ethylene oxide per mole of alcohol). The Primary Cleaning performance was evaluated according to ASTM D4488-A6.

The data on the performance for both is in Table 1.

TABLE 1

| Test Composition | % Soil Removal (SR) |
|---|---|
| Example 1, 1% active | 76.7 |
| Example 1, 0.43% active | 71.6 |
| NP-9, 1% active | 66.6 |

As illustrated in Table 1, the surfactant composition of Example 1 shows significantly improved cleaning efficacy over the NP-9. In addition, at less than one-half the concentration of NP-9, the surfactant composition shows marked improvement.

Example 2

The components of Example 1 were used in varying amounts as illustrated below in Compositions 1 through 4, All amounts are represented by percent by weight. The Primary Cleaning performance is measured in % Soil Removal (SR).

| | Compositions | | | |
|---|---|---|---|---|
| | 1 | 2 | 3 | 4 |
| A. GLUCOPON ® 215 CSUP | 58.03 | 58.03 | 58.03 | 58.03 |
| B. TRYCOL ® ST-8049 | 10.06 | 40.36 | — | 20.18 |
| C. DEHYPON ® LS-36.30 | 30.30 | — | 40.36 | 20.18 |
| D. $H_2SO4$ (30% to pH 8) | 1.61 | 1.61 | 1.61 | 1.61 |
| % SR | 81.0 | 65.3 | 75.3 | 78.0 |

As illustrated above, compositions 2 and 3 have two components, whereas compositions 1 and 4 have three components. The cleaning performance (% SR) for the three-component compositions is greater than an equal active amount used in the two-component compositions. Thus, components A+B+C>A+B or A+C, indicating a primary cleaning performance synergy is observed with components A+B+C.

Example 3

The composition according to an aspect of the invention was tested against commercially available products in removing A6 soil. A6 soil must be allowed to mix overnight before use. A6 soil has the following composition according to ASTM standards (all parts are by weight):

| A6 Soil (ASTM) | parts b/w |
|---|---|
| Stoddard Solvent | 50 |
| Vegetable Oil | 4 |
| Mineral Oil | 10 |
| Clay | 10 |
| Carbon Black | 4.5 |

The Primary Cleaning performance of the following products was evaluated and measured as follows:

| Product | % SR |
|---|---|
| FANTASTIK ® (as is) | 76.54 |
| FORMULA 409 ® (as is) | 66.04 |
| Sample 1 diluted to 1% active (Example 1) | 77.62 |

Example 4

Sample 1 of Example 1 was used as a surfactant alone, as well as in addition to a builder system consisting of 0.2% Triethanolamine and 0.3% tetrasodium EDTA, and was compared to FANTASTIK® in removing A6 soil.

| Product | % SR |
|---|---|
| FANTASTIK ® (as is) | 79.68 |
| Sample 1 (Example 1) 1% active | 78.32 |
| Sample 1 (Example 1) 1% active with builder system | 85.03 |

The results show a comparable effectiveness at 1% active, and an increased performance when used at 1% active with a builder system.

Example 5

Sample 1 of Example 1 was used as a surfactant alone, as well as in addition to a builder system consisting of 0.2% Triethanolamine and 0.3% tetrasodium EDTA, and compared to FANTASTIK® in removing H8 soil.

The Primary Cleaning performance (below) was evaluated against a different soil containing only polar oils (H8). H8 soil must be heated to 30° C. while mixing to ensure uniformity prior to application, and must be allowed to mix overnight before use. H8 soil has the following composition (all parts are by weight):

| H8 Soil | parts b/w |
|---|---|
| Kerosene | 55 |
| CRISCO ® | 6 |
| Vegetable Oil | 8 |
| Flour | 25 |
| Carbon Black | 1.5 |

The Primary Cleaning performance was measured as follows:

| Product | % SR |
|---|---|
| FANTASTIK ® (as is) | 88.82 |
| Sample 1, 1% active | 90.11 |
| Sample 1, 1% active with builder system | 93.11 |

The results show an increased effectiveness at 1% active, and a greater increase in performance when used at 1% active with the builder system.

Example 6

In this Example, the surfactant composition (SC) according to an aspect of the invention is diluted from 1:30 to 1:75 and applied to a non-woven substrate (at a weight ratio of 1:3 (cloth:liquor). In this Example, the substrate is 70% cellulosic, and 30% polyester. Other commercially available components are used as a comparison. The primary cleaning data (based on the Cognis HSC Wipes Detergency Method) for the hard surface wet wipes is as follows:

| Component | % SR |
|---|---|
| FORMULA 409 ® | 66.8 |
| CLOROX ® | 69.8 |
| LYSOL ® | 64.0 |
| MR. CLEAN | 78.1 |
| SC | 77.1 |

As illustrated above, the surfactant composition exhibited improved performance in removing soil over many of the commercially available products.

Example 7

Glycol ether EB (ethylene glycol monobutyl ether) was added to the surfactant composition (SC) (1% active) according to an aspect of the invention in amounts of from 1 to 4% by weight. It was found that the addition of glycol ether to the surfactant composition was detrimental to Primary Cleaning performance: as the amount of glycol ether EB was increased, the percent soil removal decreased, as indicated in Table 2 below.

TABLE 2

| Component | 1% active SC % wt. | +1% EB % wt. | +2% EB % wt. | +3% EB % wt. | +4% EB % wt. |
|---|---|---|---|---|---|
| Water | 98.70 | 97.70 | 96.70 | 95.70 | 94.70 |
| SC | 1.30 | 1.30 | 1.30 | 1.30 | 1.30 |
| EB | 0.00 | 1.00 | 2.00 | 3.00 | 4.00 |
| Total | 100.00 | 100.00 | 100.00 | 100.00 | 100.00 |
| Normalized % SR | 81.08 | 74.49 | 67.82 | 68.14 | 65.79 |

Although glycol ether EB contributes to the hard surface cleaning performance of other cleaners, glycol ethers are unnecessary for use with the inventive surfactant composition, as illustrated above.

The invention has been described with reference to specific embodiments. One of ordinary skill in the art, however, appreciates that various modifications and changes can be made without departing from the scope of the invention as set forth in the claims. For example, although the examples used certain alkyl polyglucosides, ethoxylated alcohols, and alkoxylated alcohols, other alkyl polyglucosides, ethoxylated alcohols, and alkoxylated alcohols may be suitable for the surfactant composition according to the invention. Accordingly, the specification is to be regarded in an illustrative manner, rather an with a restrictive view, and all such modifications are intended to be included within the scope of the invention.

Benefits, other advantages, and solutions to problems have been described above with regard to specific embodiments. The benefits, advantages, and solutions to problems, and any element(s) that may cause any benefits, advantages, or solutions to occur or become more pronounced, are not to be construed as a critical, required, or an essential feature or element of any or all of the claims.

What is claimed is:

1. A surfactant composition, comprising:

(a) from about 50% to about 60% by weight of a composition comprising from about 60% to about 65% by weight of at least one alkyl polyglycoside having an alkyl group having from about 8 to about 10 carbon atoms;

(b) from about 5% to about 15% by weight an ethoxylated alcohol with an average of about 4 moles of ethylene oxide per mole of alcohol; and (c) from about 25% to about 35% by weight an alkoxylated alcohol with an average of about 1 to about 30 moles of ethylene oxide and about 2 to about 60 moles of propylene oxide per mole of alcohol, wherein the ratio of moles of ethylene oxide to moles of propylene oxide is about 1:2.

2. The surfactant composition according to claim 1, wherein the ethoxylated alcohol has an alkyl chain length of about 8 to about 16 carbon atoms.

3. The surfactant composition according to claim 1, wherein the alkoxylated alcohol has an alkyl chain length of about 12 to about 16 carbon atoms.

4. The surfactant composition according to claim 1, wherein the alkoxylated alcohol has about 1 to about 10 moles of ethylene oxide and about 2 to about 10 moles of propylene oxide per mole of alcohol.

5. The surfactant composition according to claim 1, wherein the alkoxylated alcohol is a block ethylene oxide/propylene oxide adduct.

6. The surfactant composition according to claim 1, incorporated into a ready-to-use spray cleaner or incorporated into a concentrated cleaner.

7. The surfactant composition according to claim 1, incorporated into a wet wipe for cleaning hard surfaces.

8. A cleaning composition comprising the surfactant composition of claim 1.

9. A cleaning composition consisting essentially of the surfactant composition of claim 1 diluted with water.

10. A method for cleaning hard surfaces comprising the step of:

applying to a hard surface the surfactant composition according to claim 1.

* * * * *